United States Patent [19]

Berlaimont

[11] Patent Number: 4,896,654

[45] Date of Patent: Jan. 30, 1990

[54] POLLUTION NEUTRALIZING WOODBURNING STOVE

[75] Inventor: Claude Berlaimont, Couvin, Belgium

[73] Assignee: Fonderies Du Lion S.A., Frasnes-lez-Couvin, Belgium

[21] Appl. No.: 153,378

[22] Filed: Feb. 8, 1988

[30] Foreign Application Priority Data

Mar. 3, 1987 [BE] Belgium ..... 08700199

[51] Int. Cl.[4] ..... F24C 1/16; F23B 5/00

[52] U.S. Cl. ..... 126/58; 126/65; 126/66; 126/80; 126/83

[58] Field of Search ..... 126/77, 83, 65, 66, 126/60, 61, 58, 80

[56] References Cited

U.S. PATENT DOCUMENTS 4,258,692 3/1981 Mackey ..... 126/60
4,347,831 9/1982 Grazianio ..... 126/83
4,553,526 11/1985 von Conta ..... 126/83 X
4,611,572 9/1986 Martenson ..... 126/77
4,628,898 12/1986 von Conta ..... 126/83 X
4,683,868 8/1987 Ferguson et al. ..... 126/83 X

*Primary Examiner*—Carl D. Price
*Attorney, Agent, or Firm*—Blum Kaplan

[57] ABSTRACT

This invention concerns a solid fuel stove, in particular a wood stove fitted with a device capable of neutralizing the polluting elements of burnt gasses and that comprises, in a conventional manner, a chamber of combustion formed by vertical walls and that extends between a grate and the burnt gas flue, characterized in that the aforesaid device (12) consists of a postcombustion chamber that extends obliquely through the chamber of combustion (1) and that forms a compulsory passage heated to a high temperature level by the fuel, with the burnt gasses circulating in this device from the bottom to the top and from one wall of the hearth to the opposite wall.

6 Claims, 1 Drawing Sheet

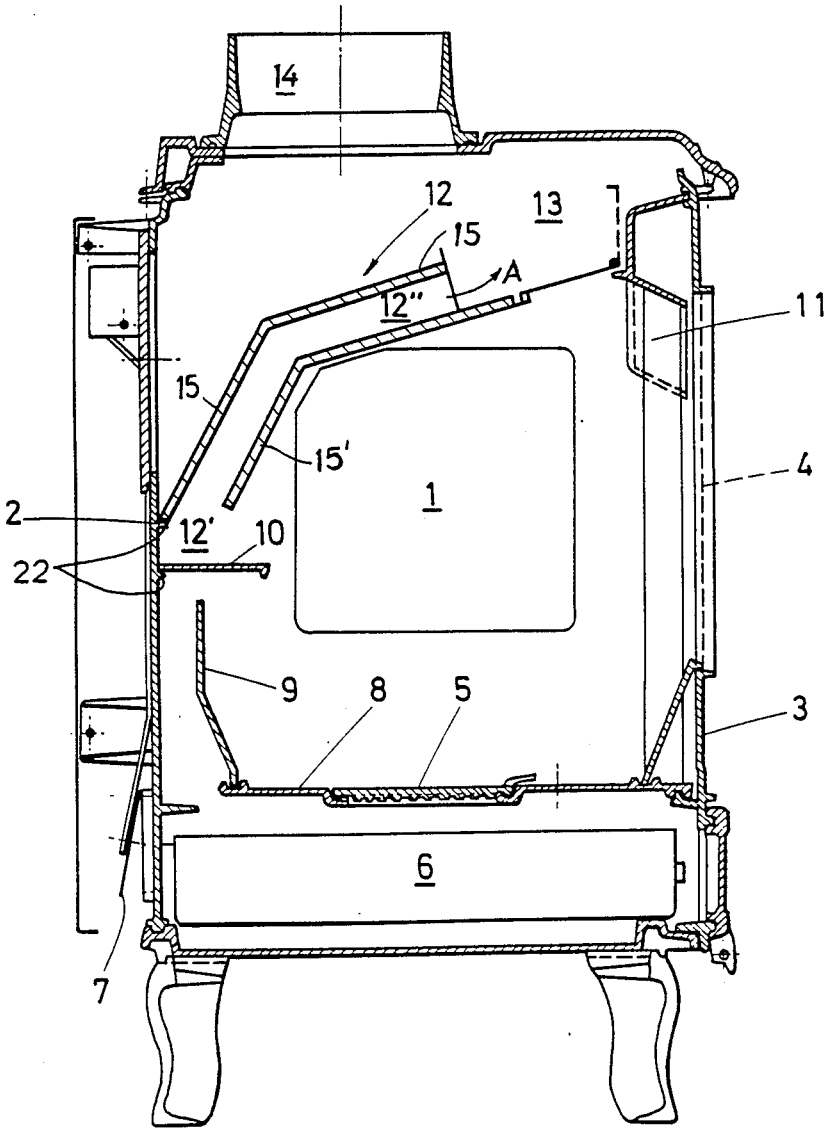
14
12
13
15
A
12''
11
15
15'
4
1
2
12'
10
22
9
8
5
3
6
7

POLLUTION NEUTRALIZING WOODBURNING STOVE

BACKGROUND OF THE INVENTION

The invention concerns a solid fuel stove, in particular a wood stove fitted with a device capable of neutralizing the polluting elements of the burnt gases and that comprises, in the conventional manner, a combustion space formed by vertical walls including two lateral walls, front wall and a rear wall, the combustion space extending between a grate and the burnt gas flue.

It is well known that the burnt gases from the combustion of the wood contain large quantities of polluting elements, the detailed list of which is given in a summary and comparative table further in this text.

It has been tried to produce combustion as complete as possible of the burnt gases by using catalyzers designed for the purpose of increasing the temperature significantly where the burnt gases are passed through. These catalyzers have a relatively short life; their catalytic activity diminishes with ageing which means that the system requires more heat at the start and that it may even fail to start at all.

The length of the life of a catalyzer will also be significantly shortened by burning materials other than natural wood such as, for instance, waste, chipboard, paper logs or artificial logs, coal, light liquids, chemical lighters, processed or paint-coated wood, floated wood or chemical cleaning agents. All of these products contain, as a matter of fact, elements that will poison the catalyzer which decreases its effectiveness very significantly.

This means, in practice, that the user will have to have the catalyzer replaced much sooner than scheduled and that, in general, this operation will be omitted so that pollution will no longer be controlled after a period of use that is shorter than scheduled. The purpose of the invention is to provide a device capable of neutralizing the polluting elements of the burnt gasses for a practically unlimited period of time as length of use of the device is practically equal to that of the stove itself.

SUMMARY OF THE INVENTION

In view of this purpose, the aforesaid device consists of a postcombustion chamber that extends obliquely between said lateral walls through the chamber of combustion and that constitutes a compulsory passage brought to high temperature by the fuel, with the gasses circulating in this device from bottom to top and from one wall of the hearth to the opposite wall.

In one preferred form of embodiment, the aforesaid postcombustion chamber consists of two metal sheets that extend obliquely from bottom to top and from the rear wall to the front wall of said combustion space.

Still according to the invention, the aforesaid postcombustion chamber is made of steel, the atmospheric scale-off temperature of which is in the range of about 1100° to 1250° C.

Other details and advantages of the invention will result from the description below of a solid fuel stove, in particular a wood stove fitted with a device capable of neutralizing the polluting elements of the gases burnt, according to the invention. This description is being given as an example only and will not restrict the invention. The references refer to the FIGURE enclosed.

BRIEF DESCRIPTION OF THE DRAWING

FIG. 1 is a sectional view according to a vertical plane of the stove fitted with the device according to the invention.

DESCRIPTION OF THE PREFERRED EMBODIMENTS

The stove shown by this FIGURE is being represented here as an example only and it consists essentially of four vertical walls that constitute the combustion space (1). The rear wall is referred to generally as (2). The front wall (3) has an opening sealed by a generally glazed door (4).

The base of the chamber of combustion is formed by a grate (5) installed, conventionally, above an ash pan (6). An air damper (7) that can be adjusted manually or by automated means, serves for controlling the draught or the combustion gas output or the combusting air admission.

The base plate (8) on which the grate is resting, supports at the rear of the chamber of combustion space, a practically vertical metal sheet (9) in order to allow for the passage of the combustive air between the top end of sheet 9 and a horizontal deflector (10).

Another opening for the passing of the combustive air is located in the upper section and at the front of the hearth and it is being referred to by (11). The combustive air that reaches the opening (11) circulates in a vertical chamber along the front wall 3 of the hearth.

The device according to the invention and designed to eliminate the polluting elements contained in the burnt gasses is being generally referred to by (12).

This device consists of two metal sheets 15, 15' that are diagonally inclined from the rear wall 2 to the front wall 3. These sheets form a bottom section (12') and a top section (12''). Laterally each of the metal sheets 15 and 15' extends up to the lateral walls of the combustion space 1.

Between themselves, the two sections (12') and (12'') form an angle as shown by FIG. 1. The sheets 15, 15' that actually form the chamber of combustion, are made of special steel with an atmospheric scale-off temperature that is very high. This temperature may range from 1100° to 1250° C. This very high temperature allows for ensuring a practically complete combustion of the residues that originate from the burning of the fuel. The postcombustion chamber formed by the device (12) is resting at the rear and laterally via the metal sheets 15, 15' that form the device, on inside projections 22 provided for at the inside surface areas of the vertical walls that form the chamber of combustion.

At the front of the postcombustion chamber exists a damper (13) that allows for ensuring that the combustion gases pass directly toward the flue (14). Arrow A illustrates the path of the combustion gases from postcombustion chamber 12 to flue 14. When this damper is in the closed position, all of the combustion gasses will have to pass through the postcombustion chamber.

The effectiveness of the device according to the invention has been tested by the applicant and the test results show a significant decrease in creosotes and various pollutants.

The effectiveness of the device has been established by comparing the amounts of non-burnt materials deposited on a filter, both in a stove fitted with a chamber of combustion and without.

The decrease in the amount of condensable volatile substances is of an order ranging from 70 to 90% which goes to show that after having passed through the chamber of combustion, the smoke contains only about 10% creosote materials as compared to 80% previously.

By heating the gasses to a very high temperature level, the amounts of certain polycyclic and non-polycyclic organic materials will be decreased considerably as shown by the table below drawn up by MONSANTO RESEARCH CORPORATION.

The comparative table below was drawn up after the polluting gasses had been heated to temperatures from about 850° to about 900° C.:

| non-P MO found to exist *1 | total of existing microg. Upflow *2 | Downflow *2 | elimination % |
|---|---|---|---|
| BENZALDEHYDE | 23 | BDL | 100 |
| HYDROXY BENZALDEHYDE | 17 | BDL | 100 |
| PHENOLS | 825 | 79 | 90 |
| CRESOLS | 534 | 58 | 89 |
| PHENOLS C2 | 110 | 37 | 66 |
| PETHOXY METHYL PHENOL | 44 | BDL | 100 |
| PHENOLS C3 | 28 | 3 | 89 |
| PHENOLS C5 | 130 | BDL | 100 |
| PHENOLS C6 | 13 | BDL | 100 |
| HYDROXYBENZOIC ACID | 84 | 10 | 88 |
| ETHYL BENZYL ETHER | 16 | BDL | 100 |
| RESORCINOL | 242 | 18 | 93 |
| METHYL PYROCATECHOL | 156 | 18 | 88 |
| VANILLIN | 180 | BDL | 100 |
| SALICYLIC ALDEHYDE | 30 | 3 | 90 |
| BENZOIC HYDROXY METHOXY ACID | 47 | 20 | 57 |
| RESORCINOL ETHYL | 35 | 4 | 89 |
| BENZALDEHYDE C3 | 48 | 4 | 92 |
| DIPHENYL ETHANE | 48 | BDL | 100 |
| METHOXY PHENYL HYDROXY ACETIC ACID | 36 | BDL | 100 |
| ALKYL DIMETHOXY PHENOL | 9 | BDL | 100 |
| DIOCTYL PHTALATE | 28 | 7 | 75 |
| ISO-PROPYLMETHYL ETHER | 16 | BDL | 100 |
| TOTAL | 2719 | 272 | 90 |

BDL: below detection level. detection level = 2 microg. of organic matter/sample
*1 non-P MO = non-polycyclic organic material may be a health hazard
*2 emissions from chamber of combustion prior to catalyzer
*3 emissions subsequent to having passed through catalyzer
*4 percentage of emissions eliminated by the catalyzer By using a postcombustion chamber heated to a high temperature level, the same results or absolutely similar results have been recorded. The interest of the device according to the invention has to be seen in the fact that it does not require any maintenance or any replacing and that its clean-up capacity will not be affected by the passing of certain types of smoke that originate from the burning of waste as described in the preamble.

The invention is not restricted, of course, to the form of embodiment described above and numerous modifications may be applied thereto without exceeding the limits of this patent application. One could consider also, for example, an anti-chamber made of fireproof materials, covered or not with catalytic materials, that would maintain a high temperature level (+1000° C.) at any setting of the stove.

What is claimed is:

1. A solid fuel stove, capable of neutralizing polluting elements of burnt gases which comprises, a combustion space delimited by essentially vertical walls, including two lateral walls, a front wall and a rear wall, and a top wall and a bottom wall; a grate on the bottom wall; and a postcombustion chamber in the combustion space that extends obliquely forward and upwardly from a region of the rear wall substantially midway between said top and bottom walls over the burning fuel and through the combustion space, said postcombustion chamber having an inlet located within said region, and further including an inwardly facing horizontal deflector projecting into the combustion space from the rear wall adjacent said inlet to the postcombustion chamber, the deflector being positioned to direct heated burnt gases up the postcombustion chamber and to circulate cooler gases in the combustion space below the deflector, said postcombustion chamber defining a compulsory passage so that burnt gases are heated to a high temperature level by the burning fuel, said burnt gases circulating in said combustion space from the bottom wall to the top wall thereof and between the two lateral walls of the combustion space.

2. The stove of claim 1, wherein the postcombustion chamber consists of two metal sheets that extend obliquely from the rear wall to the front wall of the combustion space.

3. The stove of claim 1, wherein the postcombustion chamber is located substantially in an upper half of the combustion space.

4. The stove of claim 1, wherein the postcombustion chamber consists of a bottom section and of a top section with the bottom section forming a vertical angle smaller than that formed with a vertical by the top section.

5. The stove of claim 4, further including an inwardly facing projection formed on the rear wall with the inlet end of the postcombustion chamber resting on said projection and a plurality of projections formed on at least the rear wall for supporting the intermediate section of the postcombustion chamber.

6. The stove of claim 1, wherein the postcombustion chamber is made of steel having an atmospheric scale-off temperature ranging from about 1100° to about 1250° C.

* * * * *